US006249921B1

(12) United States Patent
Daniel et al.

(10) Patent No.: US 6,249,921 B1
(45) Date of Patent: Jun. 26, 2001

(54) MODULAR BIDET SPOUT ASSEMBLY

(75) Inventors: John Daniel, Strongsville; Todd C. Loschelder, Macedonia, both of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/487,577

(22) Filed: Jan. 19, 2000

(51) Int. Cl.[7] ..... A47K 3/20; A47K 4/00; E03D 9/08

(52) U.S. Cl. ..... 4/420.4; 4/420.1; 4/443; 4/448; 239/428.5

(58) Field of Search ..... 4/420.1, 420.4, 4/420.5, 443, 447, 448, 567, 615, 601, 675–678; 239/428.5; 137/888

(56) References Cited

U.S. PATENT DOCUMENTS

| | | | | |
|---|---|---|---|---|
| 663,826 | | 12/1900 | Baker . | |
| 1,988,737 | | 1/1935 | Jauregui . | |
| 2,589,281 | | 3/1952 | Ocana . | |
| 3,164,846 | | 1/1965 | Foster . | |
| 3,425,066 | | 2/1969 | Berger . | |
| 3,430,268 | | 3/1969 | Zoberg . | |
| 3,772,710 | | 11/1973 | Coutellier . | |
| 4,136,407 | | 1/1979 | Maurer . | |
| 4,287,618 | * | 9/1981 | Silver | 4/443 |
| 4,570,274 | | 2/1986 | Kaneko et al. . | |
| 4,581,779 | | 4/1986 | Matsui et al. . | |
| 4,995,121 | | 2/1991 | Barker . | |
| 5,023,961 | | 6/1991 | Alonso . | |
| 5,114,072 | * | 5/1992 | Barhydt, Sr. | 239/428.5 |
| 5,131,428 | | 7/1992 | Bory . | |
| 5,165,121 | | 11/1992 | McTargett et al. . | |
| 5,642,755 | | 7/1997 | Mark et al. . | |
| 5,685,028 | | 11/1997 | Miller et al. . | |
| 5,746,244 | | 5/1998 | Woolley, Sr. et al. . | |
| 5,769,326 | * | 6/1998 | Muchenberger et al. | 239/428.5 |
| 5,797,151 | | 8/1998 | Ko . | |
| 5,803,120 | | 9/1998 | Bertoli . | |

FOREIGN PATENT DOCUMENTS

| | | | | |
|---|---|---|---|---|
| 2053944 | * | 5/1972 | (DE) | 239/428.5 |
| 1524933 | * | 11/1989 | (SU) | 239/428.5 |

* cited by examiner

*Primary Examiner*—Gregory L. Huson
*Assistant Examiner*—Tuan Nguyen
(74) *Attorney, Agent, or Firm*—Cook, Alex, McFarron, Manzo, Cummings & Mehler, Ltd.

(57) ABSTRACT

A bidet spout assembly includes a nozzle which has a body and a projecting conduit which functions to connect the nozzle to a water supply. The nozzle body has an interior water passage and the upper end of the nozzle body terminates in a generally planar seal seating surface. The nozzle body has an exterior wall with a threaded area thereon. A removable decorative outer cover is positioned about the nozzle body and has an interior wall with a threaded area thereon positioned for cooperation with the nozzle outer wall threaded area to removably secure the cover on the nozzle. A seal is positioned on the nozzle seal seating surface and is held in position by an aerator positioned on the seal. The aerator is held in position by the portion of the cover interior wall.

1 Claim, 1 Drawing Sheet

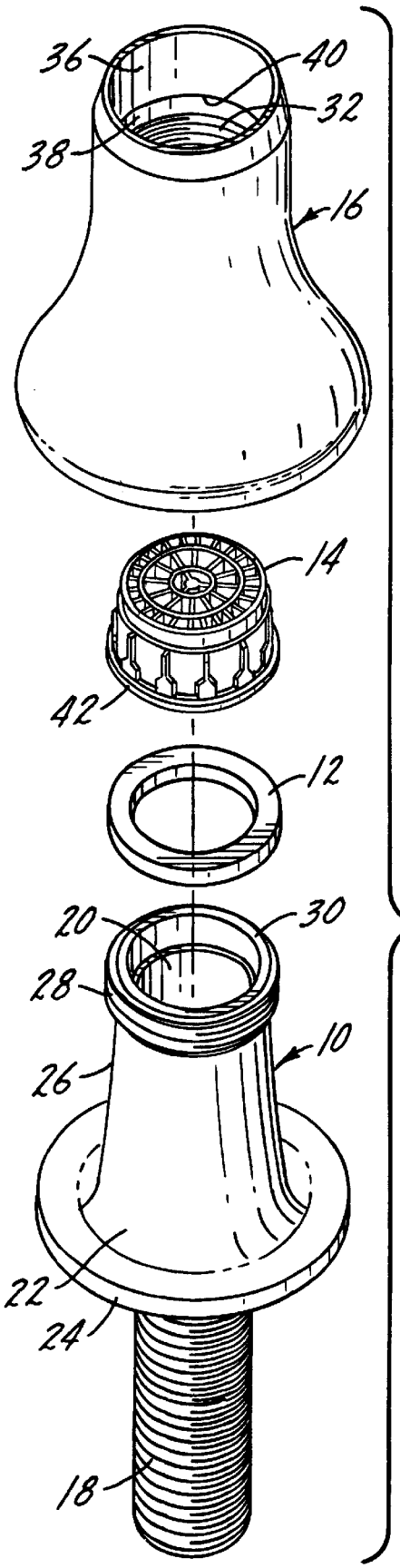
Fig.1.
Fig.2.
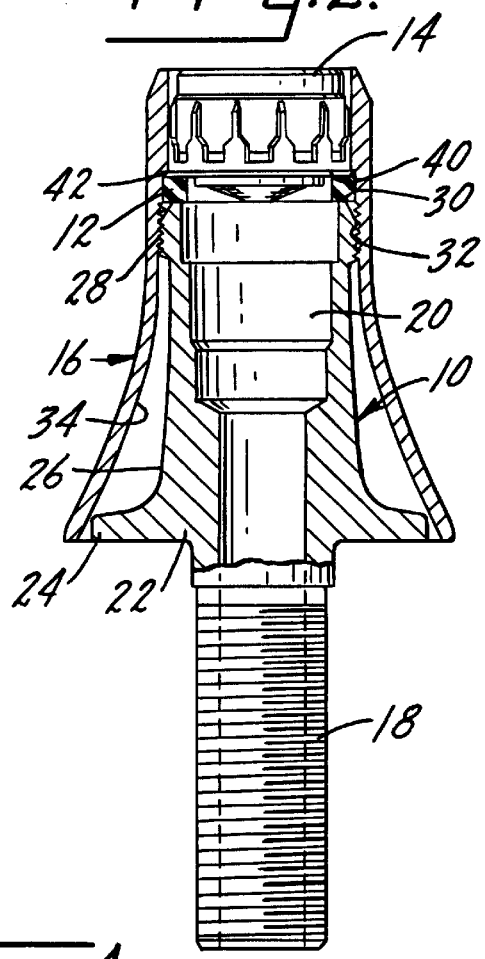
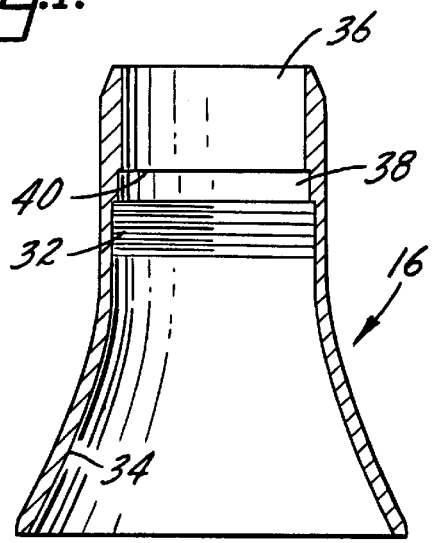
Fig.3.

MODULAR BIDET SPOUT ASSEMBLY

THE FIELD OF THE INVENTION

The present invention relates to bidet assemblies and particularly to such an assembly in which the cosmetic cover is fully replaceable, changeable or upgradable without purchasing a new nozzle unit. Such interchangeability facilitates changing the bidet appearance, color and finish material without the necessity of removing or changing any water connection and can be easily accomplished by the consumer. In particular, the present invention relates to a bidet spout assembly in which the exterior cosmetic cover is easily replaceable without affecting the connection between the nozzle and the water supply.

SUMMARY OF THE INVENTION

The present invention relates to a bidet spout assembly and in particular to such an assembly in which the exterior decorative cover may be replaced, principally for cosmetic purposes, without disturbing the underlying water supply connections.

Another purpose of the invention is a bidet spout assembly as described which is simple in construction and reliably operable.

Another purpose is a bidet spout assembly in which the outer decorative cover may be easily replaced by the consumer, without affecting the internal water connections.

Another purpose is to provide a bidet spout assembly including a nozzle, an aerator and a replaceable exterior cover, easily attached together with the cover easily removed.

Other purposes will appear in the ensuing specification, drawings and claims.

BRIEF DESCRIPTION OF THE DRAWINGS

The invention is illustrated diagrammatically in the following drawings wherein:

FIG. 1 is an exploded perspective of the bidet spout assembly of the present invention;

FIG. 2 is an axial section through the bidet spout assembly; and

FIG. 3 is an axial section through the replaceable cover.

DESCRIPTION OF THE PREFERRED EMBODIMENT

The present invention relates to a bidet spout assembly in which the outer cosmetic spout/nozzle cover is fully replaceable without disturbing or disconnecting the interior water connections. Such interchangeability facilitates altering the bidet appearance, color finish without purchasing an entirely new unit. Thus, a consumer may remodel such a bathroom fixture merely by replacing the decorative cover and does not need to utilize the services of a plumber to replace the fixture or in any way affect the water connections to the bidet. Such a concept is applicable to other plumbing fixtures besides a bidet, but the present application is specifically directed to a bidet having an interchangeable or replaceable exterior decorative cover. Further, the ability to remove the cover, without affecting the water connections, permits the cover to be replaced from the top or bowl side, again providing ease cement of this part. No special tools or skills are required.

As indicated in FIG. 1, the bidet spout assembly includes a nozzle 10, a seal ring 12, an aerator 14 and a cover 16. The nozzle 10 includes a downwardly-extending conduit 18 which is integral with the nozzle and forms an interior water passage 20 which will direct water from the water supply to which the assembly is connected up to the aerator 14. In this connection, the aerator 14 may be conventional. The nozzle 10 includes a body 22 which has an outwardly-directed annular flange 24 adjacent its base and which has an exterior wall 26 with a threaded area 28 adjacent the upper end. There is a flat planar seal seating surface 30 at the upper end of the body 22, which surface supports the seal ring 12, as particularly shown in FIG. 2. The nozzle may be made of a metallic material such as brass, or it may be made from a suitable plastic.

The exterior cover 16 which may have a finish, color and shape as desired by the consumer is indicated in the drawings to be somewhat bell-shaped, although this is not necessary. The cover 16, as particularly shown in FIG. 3, has an interior threaded area 32 on its side wall 34, which threaded area will interact with the threads 28 on the nozzle to mount to cover to the nozzle. When so mounted, the flange 24 will seat upon the surface of the bidet bowl and the cover 16 will entirely mask both the nozzle and the aerator.

The interior of the cover 16 is hollow and has an upper chamber 36 within Which is positioned the aerator 14, with the top of the aerator extending to just underneath the end or top of the cover. Directly below the chamber 36 there is a chamber 38 of slightly enlarged diameter, with there being a shoulder 40 at the transition between the chamber 38 and 36. When the bidet spout is fully assembled, as shown in FIG. 2, the seal 12 is seated upon the surface 30 and the aerator 14 is positioned upon the seal 12. The shoulder 40 will bear upon a flange 42 of the aerator so that the cover is effective to hold the aerator and seal in position in the bidet spout assembly and on the upper end of the nozzle 10. Thus, the cover not only functions to provide a decorative appearance for the bidet assembly, but also secures its elements in position for providing the bidet function.

Whereas the preferred form of the invention has been shown and described herein, it should be realized that there may be many modifications, substitutions and alterations thereto.

The embodiments of the invention in which an exclusive property or privilege is claimed are defined as follows:

1. A bidet spout assembly including an upright nozzle having a body and a conduit projecting downwardly from the body, the conduit being formed and adapted to be connected to a water supply, the nozzle body having an interior water passage to the conduit, the upper end of the body terminating in a generally planar seal seating surface, the body having an exterior wall, with a threaded area thereon directly adjacent said planar seal seating surface, a removable decorative outer cover positioned about and completely covering said nozzle body, said nozzle body having an outwardly extending flange adjacent said projecting conduit, with said cover having an exterior wall which tapers gradually outwardly and terminates generally coextensively with said nozzle body flange, said cover having an interior wall, with a threaded area thereon intermediate opposite ends thereof and positioned for cooperation with the nozzle outer wall threaded area to secure the cover on the nozzle, a seal positioned on said nozzle seal seating surface and an aerator positioned on said seal, said aerator having an outwardly extending flange, said cover interior wall portion including an inwardly directed shoulder, a chamber defined between said inwardly directed shoulder and said cover interior threaded area, with said seal being positioned within said chamber, said cover shoulder bearing on said aerator outwardly extending flange to hold said flange and seal within said bidet spout assembly.

* * * * *